US005482499A

United States Patent [19]

Satoh

[11] Patent Number: 5,482,499

[45] Date of Patent: Jan. 9, 1996

[54] SANDING APPARATUS

[75] Inventor: Hiroshi Satoh, Fuchu, Japan

[73] Assignee: Ryobi Limited, Tokyo, Japan

[21] Appl. No.: 337,775

[22] Filed: Nov. 14, 1994

[30] Foreign Application Priority Data

Nov. 18, 1993 [JP] Japan ..... 5-289607
Nov. 19, 1993 [JP] Japan ..... 5-290674

[51] Int. Cl.[6] ..... B24B 23/04
[52] U.S. Cl. ..... 451/356; 451/344
[58] Field of Search ..... 451/356, 344, 451/351, 350, 163, 357, 354

[56] References Cited

U.S. PATENT DOCUMENTS 2,350,098 5/1944 Decker ..... 451/356

FOREIGN PATENT DOCUMENTS 0333933 9/1989 European Pat. Off. ..... 451/356
3702937 8/1988 Germany .
3933885 4/1990 Germany ..... 451/357
4115862 4/1992 Japan ..... 451/350

*Primary Examiner*—Robert A. Rose
*Attorney, Agent, or Firm*—Brooks & Kushman

[57] ABSTRACT

A sanding apparatus comprises a sanding member having on a lower end thereof a flat sanding plate, and being able to oscillate a drive unit for oscillating the sanding member; a motion converting means having an oscillating arm, connected to a rotating output shaft of the drive unit, for converting a rotational motion of the output shaft to an oscillation motion; and a connecting means for connecting the oscillating arm of the motion converting means at one end thereof with the sanding member. The connecting means permits an adjustment of a securing angle of the sanding member to the oscillating arm of the motion converting means.

14 Claims, 6 Drawing Sheets

A

B

B

SANDING APPARATUS

BACKGROUND OF THE INVENTION

1. Field of the Invention

The present invention relates to a sanding apparatus, and more particularly to a sanding apparatus such as a detail sander, provided with a sanding member which is to be oscillated to perform sanding work.

2. Description of the Prior Art

A conventional sanding apparatus comprises a sanding member, a drive unit, a motion converting means and a connecting means. The sanding member has on a lower end thereof a flat sanding plate, and is able to oscillate around a rotating axis at right angles to the sanding plate. The sanding plate of the sanding member has an abrasive lower surface by attaching, for example, a sheet of sandpaper to the lower surface thereof. The drive unit comprises in general a DC motor, and causes the sanding member to oscillate around the rotating axis. The motion converting means has an oscillating arm, and is connected to a rotating output shaft of the drive unit. The motion converting means permits conversion of a rotational motion of the output shaft of the drive unit to an oscillation motion. The connecting means connects the oscillating arm of the motion converting means at one end thereof with the sanding member.

According to the conventional sanding apparatus, the rotational motion of the output shaft of the drive unit is converted to the oscillation motion of the oscillating arm by means of the motion converting means, thereby causing the oscillating arm to oscillate. The sanding member is oscillated around the rotating axis together with the oscillating arm so as to perform sanding work.

In such a sanding apparatus, a forefront portion of the abrasive lower surface of the sanding plate of the sanding member has, in general, more frequency of use than the other portion thereof. As a result, when sanding work is carried out with the use of the above-mentioned sanding apparatus, the abrasive lower surface of the sanding plate of the sanding member tends to be wore out at the forefront portion thereof at a relatively short period of time.

However, the connecting means of the above-described conventional sanding apparatus permits no adjustment of a securing angle of the sanding member to the oscillating arm of the motion converting means. When there has therefore been wore out only the forefront portion of the abrasive lower surface of the sanding plate of the sanding member, it is necessary to change the entire abrasive lower surface to a new one by peeling off a sheet of sandpaper whose forefront portion has been wore out and then attaching a new sheet of sandpaper to the lower surface of the sanding plate. This changing operation of the sheet of sandpaper causes an uneconomical problem due to a waste of sandpaper, and must be conducted with attention to preventing dust and other debris from being caught between the lower surface of the sanding plate and the new sheet of sandpaper, thus being relatively complicated and leading to a lower working efficiency.

SUMMARY OF THE INVENTION

It is an object of the present invention to provide a sanding apparatus which solves the above-mentioned problems of the conventional sanding apparatus, and permits an adjustment of a securing angle of the sanding member to the oscillating arm of the motion converting means so that an arbitrary portion of the abrasive lower surface of the sanding plate of the sanding member can be located at the forefront portion of the sanding apparatus, thus making it possible to carry out effectively detail sanding work with the selective use of a plurality of portions of the abrasive lower surface of the sanding plate, without changing the entire abrasive lower surface to a new one even if a certain portion of the abrasive lower surface of the sanding plate has been wore out.

According to one aspect of the present invention, there is provided a sanding apparatus which comprises: a sanding member having on a lower end thereof a flat sanding plate, and being able to oscillate around a rotating axis at right angles to the sanding plate; a drive unit for oscillating the sanding member around the rotating axis; a motion converting means connected to a rotating output shaft of the drive unit, for converting a rotational motion of the output shaft to an oscillation motion, the motion converting means having an oscillating arm; and a connecting means for connecting the oscillating arm of the motion converting means at one end thereof with the sanding member, which connecting means permits an adjustment of a securing angle of the sanding member to the oscillating arm of the motion converting means.

The above-mentioned motion converting means preferably comprises the oscillating arm and an eccentric roller secured to the output shaft of the drive unit, and the oscillating arm preferably has at the other end thereof a fork for receiving the eccentric roller so that the eccentric roller is rotatable in the fork.

In a preferred embodiment of the present invention, the above-mentioned connecting means comprises a hollow support shaft secured stationarily to the one end of the oscillating arm and at right angles thereto, a bolt which has at the tip portion thereof a threaded portion, passing through an upper portion of the sanding member and inserted into the hollow support shaft, a nut engaged with the threaded portion of the bolt, for urging the sanding member against a lower end of the hollow support shaft by tightening the nut, and a securing angle adjusting mechanism for ensuring a prescribed securing angle of the sanding member to the hollow support shaft.

In another preferred embodiment of the present invention, the above-mentioned oscillating arm of the motion converting means has at the one end thereof a boss provided with a through-hole in a direction at right angles to the oscillating arm; and the above-mentioned connecting means comprises a support shaft provided upwardly on an upper portion of the sanding member and being rotatably inserted into the through-hole of the boss of the oscillating arm, and a securing angle adjusting mechanism for ensuring a prescribed securing angle of the sanding member to the oscillating arm.

DETAILED DESCRIPTION OF THE PREFERRED EMBODIMENT

A sanding apparatus of a first embodiment of the present invention will be described below with reference to FIGS. 1 to 5.

Figure 1:
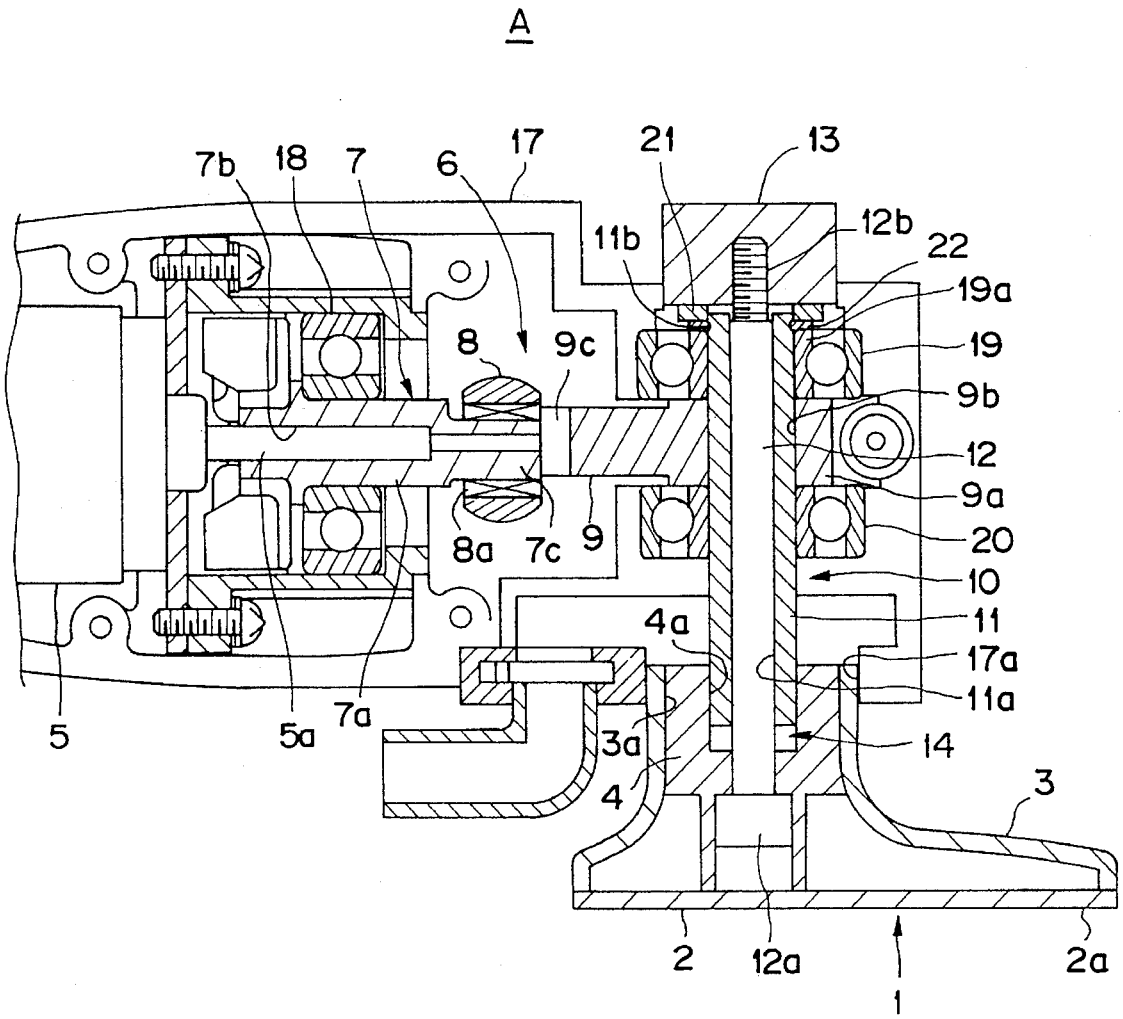
FIG. 1 is a vertical sectional view illustrating a sanding apparatus of a first embodiment of the present invention.
Figure 2:
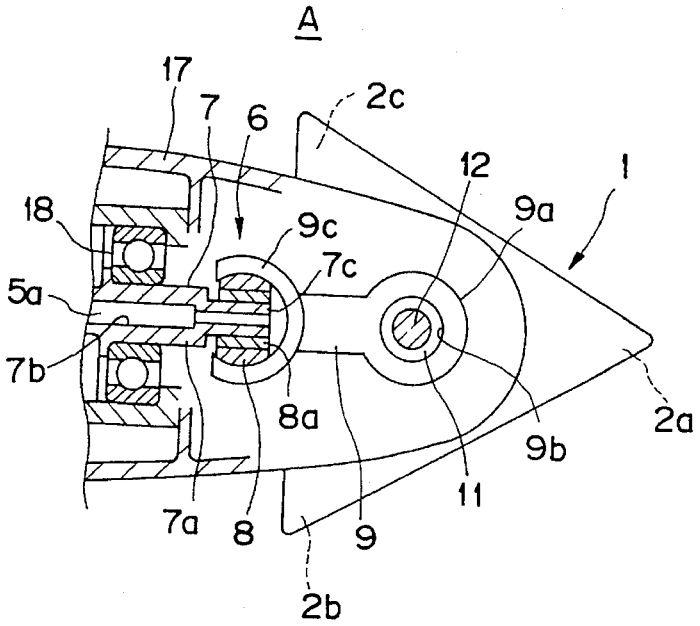
FIG. 2 is a transverse sectional view illustrating the sanding apparatus of the first embodiment of the present invention.
Figure 3:
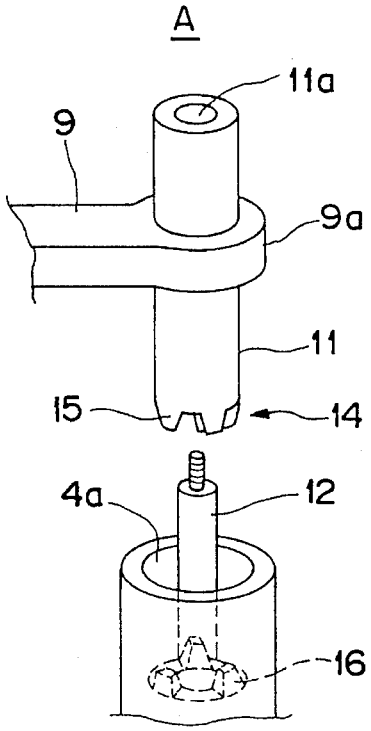
FIG. 3 is an exploded perspective view illustrating a securing angle adjusting mechanism of the sanding apparatus of the first embodiment of the present invention.

FIG. 1 is a vertical sectional view illustrating the sanding apparatus of the first embodiment of the present invention, and FIG. 2 is a transverse sectional view illustrating the sanding apparatus of the first embodiment thereof. As shown in FIG. 1, the sanding apparatus A of the first embodiment of the present invention comprises a sanding member 1, a drive unit 5, a motion converting means 6 and a connecting means 10.

The sanding member 1 has a triangular shape as shown in FIG. 2. The sanding member 1 comprises a shoe 3, a flat sanding plate 2 secured by means of screws (not shown) to the lower end of the shoe 3 and having a triangular shape provided with three corners 2*a*, 2*b* and 2*c*, and a supporting member 4 fitted into a hole 3*a* provided at the upper portion of the shoe 3. The supporting member 4 has on the upper end thereof a cylindrical hole 4a for receiving a lower portion of a hollow support shaft 11 described later of the connecting means 10. The sanding plate 2 has on the lower surface thereof an abrasive surface formed by attaching a sheet of sandpaper to the lower surface of the sanding plate 2. The upper portion of the sanding member 1 is to be inserted into a lower opening 17*a* formed at the front lower portion of a casing 17 so as to be able to oscillate around a rotating axis at right angles to the sanding plate 2.

The drive unit 5 comprises a DC motor as in the conventional sanding apparatus. The drive unit 5 is housed in the casing 17 so that the output shaft 5a thereof is arranged horizontally as shown in FIG. 1. The drive unit 5 may include a gear box, if necessary.

The motion converting means 6 permits conversion of a rotational motion of the output shaft 5*a* of the drive unit 5 to an oscillation motion. The motion converting means 6 comprises a connecting shaft 7, an eccentric roller 8 and an oscillating arm 9.

The connecting shaft 7 comprises a base portion 7*a* having a horizontal hole 7*b* into which the output shaft 5*a* of the drive unit 5 is to be fitted, and an eccentric portion 7*c* horizontally projected from one end of the base portion 7*a* so that the axis of the eccentric portion 7*c* is eccentric to that of the base portion 7*a*. The above-described connecting shaft 7 is supported rotatably at the base portion 7*a* through a bearing 18 mounted on the casing 17. The output shaft 5*a* of the drive unit 5 is fitted stationarily into the horizontal hole 7*b* of the connecting shaft 7.

The eccentric roller 8 is secured to the eccentric portion 7*c* of the connecting shaft 7 through a bearing 8*a*. The rotating axis of the eccentric roller 8 is eccentric to the rotating axis of the output shaft 5*a* of the drive unit 5 due to the eccentricity of the axis of the eccentric portion 7*c* of the connecting shaft 7 to that of the base portion 7*a* thereof.

The oscillating arm 9 has at one end thereof a boss 9*a* provided with a vertical through-hole 9*b* which is at right angles to the longitudinal direction of the oscillating arm 9, and has at the other end thereof a fork 9*c* for receiving the above-described eccentric roller 8. The oscillating arm 9 is arranged horizontally in the casing 17 as shown in FIG. 1 so that the eccentric roller 8 is rotatably received in the fork 9*c* of the oscillating arm 9, as best shown in FIG. 2.

The connecting means 10 connects the one end of the oscillating arm 9 of the motion converting means 6 with the sanding member 1. The connecting means 10 comprises a hollow support shaft 11, fixing mechanism including a bolt 12 and a nut 13, and a securing angle adjusting mechanism 14.

The hollow support shaft 11 has a cylindrical shape and has on the peripheral surface of the top end portion thereof a ring-shaped groove 11*b*. The hollow support shaft 11 is stationarily fitted into the vertical through-hole 9*b* of the oscillating arm 9. The hollow support shaft 11 is supported rotatably through a pair of bearings, i.e., an upper bearing 19 and a lower bearing 20 mounted on the casing 17, between which bearings the boss 9*a* of the oscillating arm 9 is caught. A snap ring 22 is fitted into the ring-shaped groove 11*b* of the hollow support shaft 11. The lower surface of the snap ring 22 is in contact with the inner race 19*a* of the upper bearing 19, thus preventing the hollow support shaft 11 from moving downwardly.

The bolt 12 has at the tip portion thereof a threaded portion 12*b*. The bolt 12 passes through the upper portion, i.e., the supporting member 4 of the sanding member 1 and is inserted into the vertical through-hole 11*a* of the hollow support shaft 11.

The nut 13 is engaged with the threaded portion 12*b* of the bolt 12 through a washer 21. The lower surface of the washer 21 is in contact with the snap ring 22, and the upper surface of the washer 21 is in contact with the lower surface of the nut 13. The sanding member 1 can be urged against the lower end of the hollow support shaft 11 by tightening the nut 13.

The securing angle adjusting mechanism 14 ensures a prescribed securing angle of the sanding member 1 to the hollow support shaft 11. The securing angle adjusting mechanism 14 comprises three projections 15 formed on the lower end of the hollow support shaft 11 at equal intervals of an angle of 120° in the circumferential direction thereof, and three recesses 16 formed on the bottom of the cylindrical hole 4*a* of the sanding member 1 at equal intervals of an angle of 120° in the circumferential direction thereof, so that the three projections 15 can be engaged with the three recesses 16, respectively.

The operation of the sanding apparatus A of the first embodiment of the present invention will be explained in detail hereafter.

First, the DC motor as the drive unit 5 is turned on to rotate the output shaft 5*a* together with the connecting shaft 7, resulting in an eccentric movement of the eccentric roller 8 due to the eccentricity of the axis of the eccentric portion 7*c* of the connecting shaft 7 to that of the base portion 7*a* thereof. Such an eccentric movement of the eccentric roller 8 causes the oscillating arm 9 to oscillate around a center axis of the vertical through-hole 9*b* at the one end of the oscillating arm 9, because the eccentric roller 8 is rotatably received in the fork 9*c* of the oscillating arm 9. In this manner, the rotational motion of the output shaft 5*a* of the drive unit 5 is converted to the oscillation motion of the oscillating arm 9 by means of the motion converting means 6 which comprises the eccentric roller 8 and the oscillating arm 9. The oscillation motion of the oscillating arm 9 causes the sanding member 1 to oscillate around the rotating axis, because the one end of the oscillating arm 9 is connected with the sanding member 1 by means of the connecting means 10. Thus, the desired sanding work can be carried out.

When the abrasive lower surface at the corner 2*a* of the sanding plate 2 of the sanding member 1 has been worn out, the nut 13 is loosened until the engagement of the projections 15 of the hollow support shaft 11 with the recesses 16 of the sanding member 1 is released. After releasing the above-mentioned engagement, the sanding member 1 becomes rotatable relative to the hollow support shaft 11. Then, the sanding member 1 is turned around the rotating axis by an angle of 120°, so that the other corner 2*b* or 2*c* of the sanding plate 2 of the sanding member 1 is located at the forefront portion of the sanding apparatus A. The nut 13 is then tightened to urge the sanding member 1 against the lower end of the hollow support shaft 11, with the result that the projections 15 of the hollow support shaft 11 are engaged with the recesses 16 of the sanding member 1, thus ensuring the securing angle of the sanding member 1 to the hollow support shaft 11.

In this manner, a detail sanding work can be carried out effectively with the use of three portions 2*a*, 2*b* and 2*c* of the sanding plate 2 of the sanding member 1 without changing the entire abrasive surface of the sanding plate 2 to a new one. Needless to say, the sanding member 1 can be removed from the hollow support shaft 11 by loosening and removing the nut 13 from the threaded portion 12*b* of the bolt 12, in order to change the sanding member 1 itself to a new one.

In the above-described sanding apparatus A of the first embodiment of the present invention, the sanding plate 2 is secured by means of the screws to the lower end of the shoe 3. However, the sanding member 1 may be integrally provided with the sanding plate 2. There may be used in the fixing mechanism, in replacement of the bolt 12, a threaded bar integrally and upwardly provided on the upper portion of the sanding member 1.

In the above-described sanding apparatus A of the first embodiment of the present invention, the securing angle adjusting mechanism 14 comprises three projections 15 formed on the lower end of the hollow support shaft 11 at equal intervals of an angle of 120° in the circumferential direction thereof, and three recesses 16 formed on the bottom of the cylindrical hole 4*a* of the sanding member 1 at equal intervals of an angle of 120° in the circumferential direction thereof. However, these projections 15 may be formed on the bottom of the cylindrical hole 4*a* of the sanding member 1, and these recesses 16 may be formed on the lower end of the hollow support shaft 11. In addition, a number of the projections 15 and a number of the recesses 16 are arbitrary provided that (1) a number of the projections 15 is equal to or smaller than that of the recesses 16, (2) the projections 15 are formed on any one of the lower end of the hollow support shaft 11 and the bottom of the cylindrical hole 4*a* of the sanding member 1, at equal intervals of an prescribed angle in the circumferential direction thereof, and the recesses 16 are formed on any other of the lower end of the hollow support shaft 11 and the bottom of the cylindrical hole 4*a* of the sanding member 1, at equal intervals of an prescribed angle in the circumferential direction thereof, and (3) the former prescribed angle is equal to or of a multiple of the latter prescribed angle. For example, six projections may be formed on the lower end of the hollow support shaft 11 at equal intervals of an angle of 60° in the circumferential direction thereof, and six recesses may be formed on the bottom of the cylindrical hole 4*a* of the sanding member 1 at equal intervals of an angle of 60° in the circumferential direction thereof. In this case, there may be used, in replacement of the six projections mentioned above, three projections formed on the lower end of the hollow support shaft 11 at equal intervals of an angle of 120° in the circumferential direction thereof.

Figure 4:
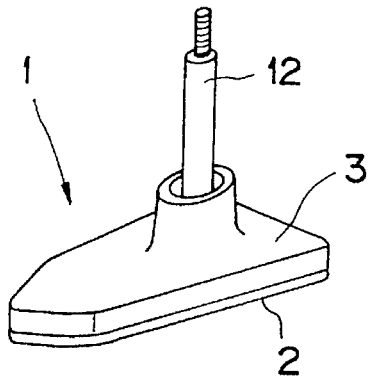
FIG. 4 is a perspective view illustrating a modification of a sanding member of the sanding apparatus of the first embodiment of the present invention.
Figure 5:
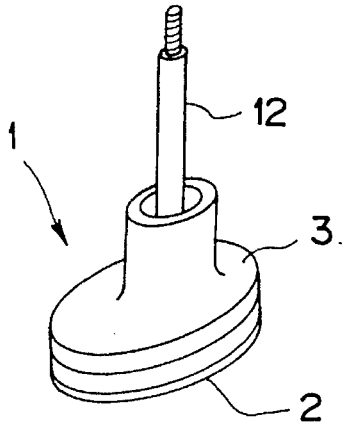
FIG. 5 is a perspective view illustrating another modification of the sanding member of the sanding apparatus of the first embodiment of the present invention.

In the above-described sanding apparatus A of the first embodiment of the present invention, the sanding plate 2 of the sanding member 1 is formed into a triangular shape. The sanding plate 2 may however be formed into a circular shape, a polygonal shape, a trowel-shape as shown in FIG. 4, or an oval shape as shown in FIG. 5. If a plurality of sanding plates having such different shapes are prepared, a sanding work can be carried out effectively with the use of the sanding plate having the desired shape optionally selected from the plurality of sanding plates thus prepared.

A sanding apparatus of a second embodiment of the present invention will be described below with reference to FIGS. 6 to 8.

Figure 6:
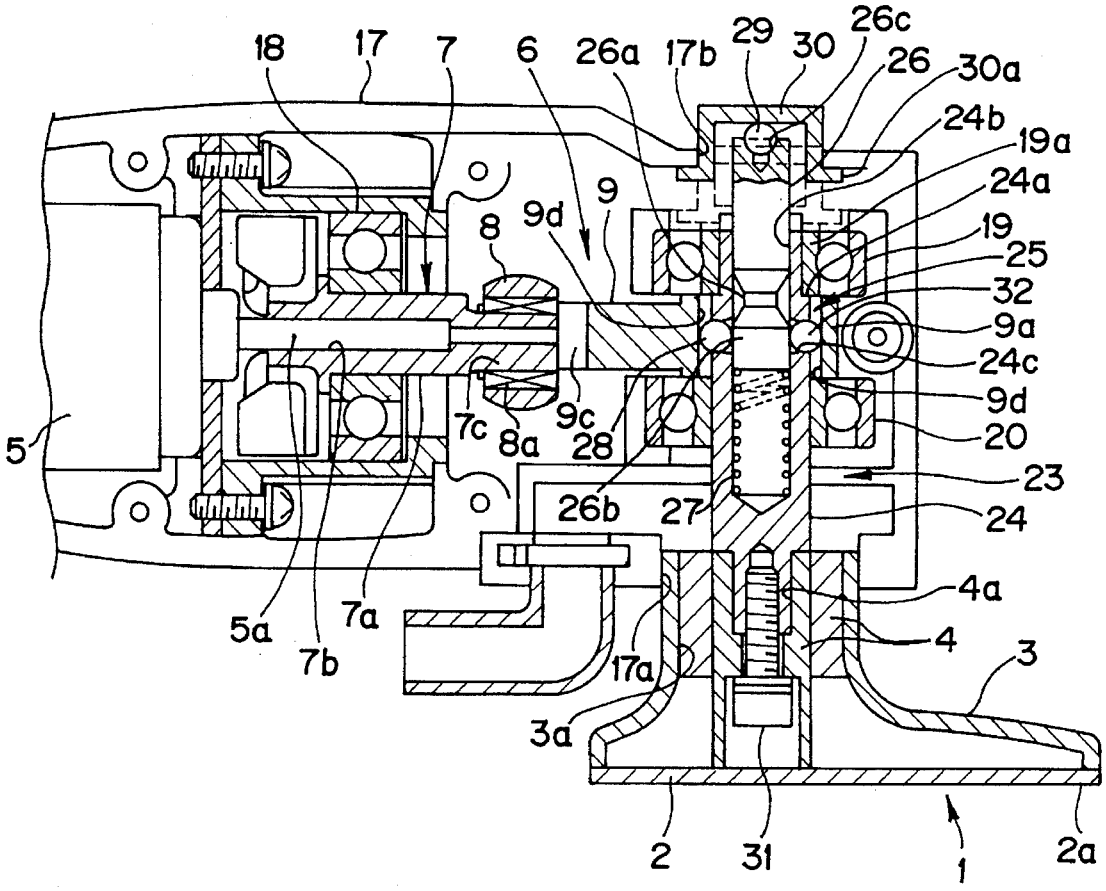
FIG. 6 is a vertical sectional view illustrating a sanding apparatus of a second embodiment of the present invention.
Figure 7:
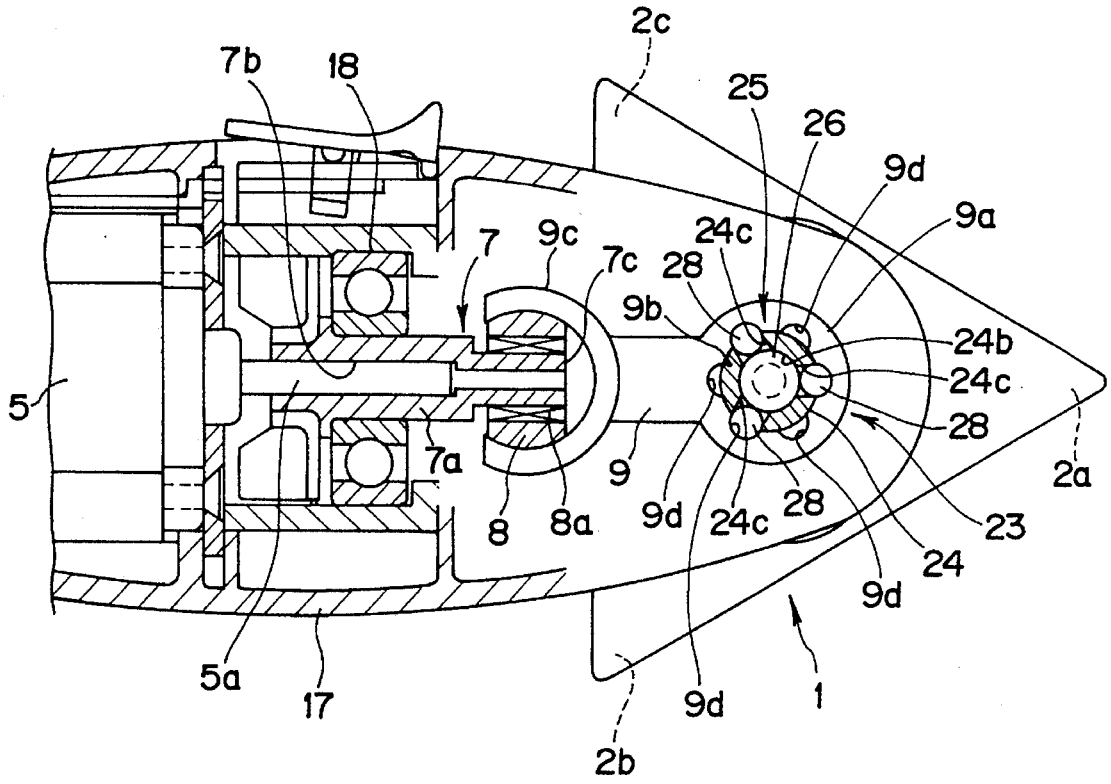
FIG. 7 is a transverse sectional view illustrating the sanding apparatus of the second embodiment of the present invention.
Figure 8:
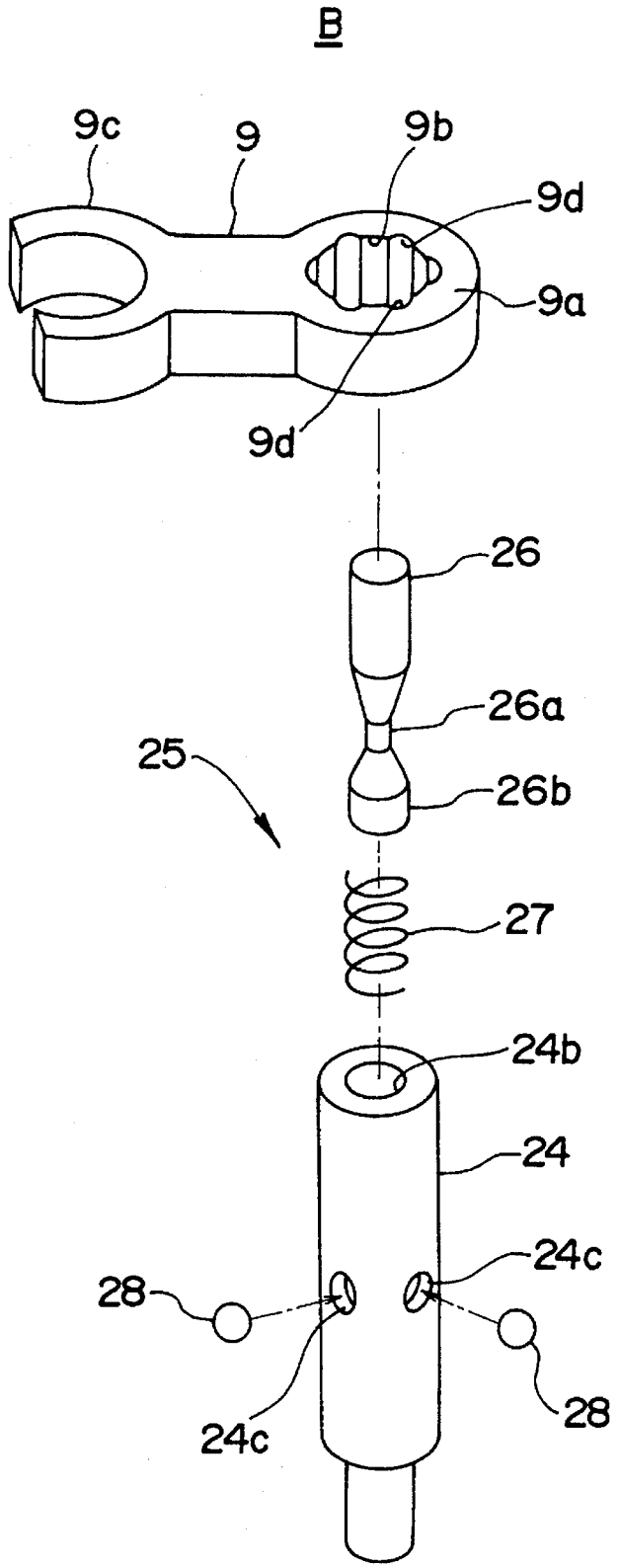
FIG. 8 is an exploded perspective view illustrating a securing angle adjusting mechanism of the sanding apparatus of the second embodiment of the present invention.

FIG. 6 is a vertical sectional view illustrating the sanding apparatus of a second embodiment of the present invention, and FIG. 7 is a transverse sectional view illustrating the sanding apparatus of the second embodiment thereof. As shown in FIG. 6, the sanding apparatus B of the second embodiment of the present invention comprises a sanding member 1, a drive unit 5, a motion converting means 6 and a connecting means 23.

The sanding member 1 of the sanding apparatus B of the second embodiment of the present invention comprises the same components as those of the sanding member 1 of the above-described sanding apparatus A of the first embodiment of the present invention, except that, in the former, there are no components corresponding to the recesses 16 formed on the bottom of the cylindrical hole 4*a* of the latter, and the supporting member 4 of the former is secured to the lower end of a support shaft 24 described later by means of a screw 31. The same reference numerals are therefore assigned to the corresponding components, and description thereof is omitted.

The drive unit 5 and the motion converting means 6 of the sanding apparatus B of the second embodiment of the present invention comprise the same components as those of the drive unit 5 and the motion converting means 6 of the above-described sanding apparatus A of the first embodiment of the present invention, respectively. The same reference numerals are therefore assigned to the corresponding components, and description thereof is omitted. The oscillating arm 9 of the motion converting means 6 has at one end thereof a boss 9*a* provided with a vertical through-hole 9*b* in a direction at right angles to the oscillating arm 9.

The connecting means 23 comprises a support shaft 24 and a securing angle adjusting mechanism 25.

The support shaft 24 is secured at the lower end thereof to the supporting member 4 of the sanding member 1 by means of a screw 31. The support shaft 24 is rotatably inserted into the vertical through-hole 9*b* of the boss 9*a* of the oscillating arm 9. The support shaft 24 is supported rotatably through a pair of bearings, i.e., an upper bearing 19 and a lower bearing 20 mounted on the casing 17, between which bearings the boss 9*a* of the oscillating arm 9 is caught. The support shaft 24 has at the upper portion thereof a shoulder 24*a* which is in contact with the lower end of the inner race 19*a* of the upper bearing 19, thus preventing the support shaft 24 from moving upwardly.

The securing angle adjusting mechanism 25 ensures a prescribed securing angle of the sanding member 1 to the oscillating arm 9. The securing angle adjusting mechanism 25 comprises six ball receptacles 9*d* formed on the oscillating arm 9, a plunger chamber 24*b* formed in the support shaft 24, three horizontal through-holes 24*c* formed in the support shaft 24, a plunger 26 arranged in the plunger chamber 24*b*, a coil spring 27 arranged in the plunger chamber 24*b*, and three balls 28 respectively arranged in the three horizontal through-holes 24*c*.

The six ball receptacles 9*d* comprise six grooves which are formed on a circumferential surface of the vertical through-hole 9*b* of the boss 9*a* of the oscillating arm 9 at equal intervals at an angle of 60° in the circumferential direction of the vertical through-hole 9*b*. These six ball receptacles 9*d* extend over the entire of the vertical through-hole 9*b* of the boss 9*a* in the axial direction of the vertical through-hole 9*b* of the boss 9*a*.

The plunger chamber 24*b* is formed inside the upper portion of the support shaft 24 in the longitudinal direction thereof.

The three horizontal through-holes 24*c* is formed in the support shaft 24 at equal intervals at an angle of 120° in the circumferential direction thereof so as to communicate three of the six ball receptacles 9*d* with the plunger chamber 24*b*.

The plunger 26 has at the lower portion thereof a neck portion 26*a*, and at the upper end thereof a recess 26*c*. The plunger 26 is arranged in the plunger chamber 24*b* of the support shaft 24 so as to be reciprocally slidable therein.

The coil spring 27 is arranged in the plunger chamber 24*b* so as to push up the plunger 26.

Each of the three balls 28 has a diameter slightly smaller than that of the horizontal through-hole 24*c* of the support shaft 24. These three balls 28 are respectively arranged in the three horizontal through-holes 24*c* of the support shaft 24 as best shown in FIG. 7.

A hat-shaped button 30 having a flange 30*a* is inserted from below into an upper opening 17*b* of the casing 17, which is formed above the plunger 26 arranged in the plunger chamber 24*b* of the support shaft 24. As shown in FIG. 6, a ball 28 is received in the recess 26*c* formed on the top end of the plunger 26 so that the top of the ball 28 is in contact with the button 30. The ball 29 decreases the frictional force between the top end-of the plunger 26 and the button 30, thus permitting the smooth oscillation of the sanding member 1 together with the support shaft 24 and the plunger 26.

The operation of the sanding apparatus B of the second embodiment of the present invention will be explained in detail hereafter.

When the DC motor as the drive unit 5 is turned on, the rotational motion of the output shaft 5*a* of the drive unit 5 is converted to the oscillation motion of the oscillating arm 9 by means of the motion converting means 6 in the same manner as set forth in the description of the operation of the sanding apparatus A of the first embodiment of the present invention.

As shown in FIG. 6, the plunger 26 is pushed up in the plunger chamber 24*b* by means of the coil spring 27 and the plunger 26 is located at its higher position, i.e., the locking position. When the plunger 26 is thus located at the locking position, the balls 28 are in contact with the lower portion 26*b* of the plunger 26, and the outer half portions of these balls 28 are received into the respective ball receptacles 9*d* of the oscillating arm 9, thus curbing the movement of the balls 28. The prescribed securing angle of the sanding member 1 to the oscillating arm 9 is thus ensured by making it impossible for the balls 28 to enter the neck portion 26*a* of the plunger 26. As a result, the above-mentioned oscillation motion of the oscillating arm 9 causes the sanding member 1 to oscillate around the rotating axis. Thus, the desired sanding work can be carried out.

When the abrasive lower surface at the corner 2*a* of the sanding plate 2 of the sanding member 1 has been wore out, the plunger 26 is pushed down against the effect of the coil spring 27 by pressing down the button 30 with the result that the plunger 26 is located at its lower position, i.e., the releasing position. When the plunger 26 is thus located at the releasing position, it is possible for the balls 28 to enter the neck portion 26*a* of the plunger 26. Then, the sanding member 1 is turned around the rotating axis by an angle of 120°, so that the other corner 2*b* or 2*c* of the sanding plate 2 of the sanding member 1 is located at the forefront portion of the sanding apparatus B. The balls 28 enter the neck portion 26*a* of the plunger during the above-mentioned turn of the sanding member 1. When the above-mentioned pressing of the button 30 is then released, the plunger 26 is pushed up again by the effect of the coil spring 27 so as to locate at the locking position. When the plunger 26 is thus located at the locking position, the balls 28 are in contact with the lower portion 26*b* of the plunger 26, and the outer half portions of these balls 28 are received again into the respective ball receptacles 9*d* of the oscillating arm 9, thus curbing the movement of the balls 28. Another prescribed securing angle of the sanding member 1 to the oscillating arm 9 is thus ensured by making it impossible for the balls 28 to enter the neck portion 26*a* of the plunger 26.

In this manner, a detail sanding work can be carried out effectively with the use of three portions 2*a*, 2*b* and 2*c* of the sanding plate 2 of the sanding member 1 without changing the entire abrasive surface of the sanding plate 2 to a new one. Needless to say, the sanding member 1 can be removed from the support shaft 24 by removing the screw 31, in order to change the sanding member 1 itself to a new one.

In the above-described sanding apparatus B of the second embodiment of the present invention, the sanding plate 2 of the sanding member 1 is formed in a triangular shape. The sanding plate 2 may however be formed in an arbitrary shape such as a circular shape, a polygonal shape, a trowel-shape, or an oval shape. If a plurality of sanding plates having such different shapes are prepared, a sanding work can be carried out effectively with the use of the sanding plate having the desired shape optionally selected from the plurality of sanding plates thus prepared.

In the above-described sanding apparatus B of the second embodiment of the present invention, the ball receptacles 9*d* comprise the grooves which extend over the entire of the vertical through-hole 9*b* of the boss 9*a* in the axial direction of the vertical through-hole 9*b* of the boss 9*a*. The ball receptacles 9*d* may however comprise hemispheric recesses formed on a circumferential surface of the vertical through-hole 9*b* of the boss 9*a* of the oscillating arm 9.

According to the present invention, as described above in detail, it is possible to provide a sanding apparatus which permits an adjustment of a securing angle of the sanding member to the oscillating arm of the motion converting means so that an arbitrary portion of the abrasive lower surface of the sanding plate of the sanding member can be located at the forefront portion of the sanding apparatus, thus making it possible to carry out effectively detail sanding work with the selective use of a plurality of portions of the abrasive lower surface of the sanding plate, without changing the entire abrasive lower surface to a new one even if a certain portion of the abrasive lower surface of the sanding plate has been wore out, thus providing industrially useful effects.

What is claimed is:

1. A sanding apparatus which comprises:

a sanding member having on a lower end thereof a flat sanding plate, and being able to oscillate around an axis at right angles to said sanding plate;

a drive unit for oscillating said sanding member around said axis;

a motion converting means connected to a rotating output shaft of said drive unit, for converting a rotational motion of said output shaft to an oscillation motion, said motion converting means having an oscillating arm including a first end and a second end; and a connecting means for connecting said oscillating arm of said motion converting means at said first end thereof with said sanding member, said connecting means comprising a hollow support shaft secured stationarily to said first end of said oscillating arm and at right angles thereto, a fixing mechanism for detachably fixing said sanding member to said hollow support shaft, and a securing angle adjusting mechanism for ensuring a prescribed securing angle of said sanding member to said hollow support shaft, said securing angle adjusting mechanism comprising at least one projection formed on any one of said lower end of said hollow support shaft and an upper portion of said sanding member, and a plurality of recesses formed on any other of said lower end of said hollow support shaft and said upper portion of said sanding member so that said at least one projection can selectively be received into at least one of said plurality of recesses.

2. The apparatus as claimed in claim 1, wherein:

said motion converting means comprises said oscillating arm and an eccentric roller secured to said output shaft of said drive unit, said oscillating arm having at said second end thereof a fork for receiving said eccentric roller so that said eccentric roller is rotatable in said fork.

3. The apparatus as claimed in claim 1, wherein:

said fixing mechanism comprises a bolt which has at a tip portion thereof a threaded portion, passing through said upper portion of said sanding member and inserted into said hollow support shaft, and a nut engaged with said threaded portion of said bolt, for urging said sanding member against said lower end of said hollow support shaft by tightening said nut.

4. The apparatus as claimed in claim 2, wherein:

said fixing mechanism comprises a bolt which has at a tip portion thereof a threaded portion, passing through said upper portion of said sanding member and inserted into said hollow support shaft, and a nut engaged with said threaded portion of said bolt, for urging said sanding member against said lower end of said hollow support shaft by tightening said nut.

5. The apparatus as claimed in claim 1, wherein:

said sanding member is integrally provided with said sanding plate; and said fixing mechanism comprises a threaded bar integrally and upwardly provided on said upper portion of said sanding member, and inserted into said hollow support shaft, and a nut engaged with a tip portion of said threaded bar, for urging said sanding member against said lower end of said hollow support shaft by tightening said nut.

6. The apparatus as claimed in claim 2, wherein:

said sanding member is integrally provided with said sanding plate; and said fixing mechanism comprises a threaded bar integrally and upwardly provided on said upper portion of said sanding member, and inserted into said hollow support shaft, and a nut engaged with a tip portion of said threaded bar, for urging said sanding member against said lower end of said hollow support shaft by tightening said nut.

7. The apparatus as claimed in claim 1, wherein:

at least lower portion of said hollow support shaft has a cylindrical shape;

said upper portion of said sanding member has a cylindrical hole for receiving said lower portion having said cylindrical shape of said hollow support shaft; and said at least one projection of said securing angle adjusting mechanism comprises a plurality of projections which are formed on said lower end of said hollow support shaft at equal intervals in the circumferential direction thereof, and said plurality of recesses of said securing angle adjusting mechanism are formed on a bottom of said cylindrical hole of said sanding member at equal intervals in the circumferential direction thereof, so as to be able to receive said plurality of projections, respectively.

8. The apparatus as claimed in claim 2, wherein:

at least lower portion of said hollow support shaft has a cylindrical shape;

said upper portion of said sanding member has a cylindrical hole for receiving said lower portion having said cylindrical shape of said hollow support shaft; and said at least one projection of said securing angle adjusting mechanism comprises a plurality of projections which are formed on said lower end of said hollow support shaft at equal intervals in the circumferential direction thereof, and said plurality of recesses of said securing angle adjusting mechanism are formed on a bottom of said cylindrical hole of said sanding member at equal intervals in the circumferential direction thereof, so as to be able to receive said plurality of projections, respectively.

9. A sanding apparatus which comprises:

a sanding member having on a lower end thereof a flat sanding plate, and being able to oscillate around an axis at right angles to said sanding plate;

a drive unit for oscillating said sanding member around said axis;

a motion converting means connected to a rotating output shaft of said drive unit, for converting a rotational motion of said output shaft to an oscillation motion, said motion converting means having an oscillating arm including a first end and a second end and which has at said first end thereof a boss provided with a through-hole in a direction at right angles to said oscillating arm; and a connecting means for connecting said oscillating arm of said motion converting means at said first end thereof with said sanding member, said connecting means comprising a support shaft provided upwardly on an upper portion of said sanding member and being rotatably inserted into said through-hole of said boss of said oscillating arm, and a securing angle adjusting mechanism for ensuring a prescribed securing angle of said sanding member to said oscillating arm, said securing angle adjusting mechanism comprising a plurality of ball receptacles formed on a circumferential surface of said through-hole of said boss of said oscillating arm in the circumferential direction of said through-hole, a plunger chamber formed in an inside of said support shaft in the longitudinal direction thereof, at least one through-hole formed in said support shaft so as to communicate least one of said plurality of ball receptacles with said plunger chamber, a plunger having a neck portion, arranged in said plunger chamber so as to be reciprocally slidable therein, a spring arranged in said plunger chamber, for pushing up said plunger, and at least one ball respectively arranged in said at least one through-hole of said support shaft, whereby said prescribed securing angle of said sanding member to said oscillating arm is ensured by making it impossible for said at least one ball to enter said neck portion of said plunger, when said plunger is pushed up in said plunger chamber under the effect of said spring, and on the other hand, said ensuring of said prescribed securing angle of said sanding member to said oscillating arm is released by making it possible for said at least one ball to enter said neck portion of said plunger, when said plunger is pushed down in said plunger chamber against the effect of said spring.

10. The apparatus as claimed in claim 9, wherein:

said motion converting means comprises said oscillating arm and an eccentric roller secured to said output shaft of said drive unit, said oscillating arm having at said second end thereof a fork for receiving said eccentric roller so that said eccentric roller is rotatable in said fork.

11. The apparatus as claimed in claim 9, wherein:

said plurality of ball receptacles of said oscillating arm comprise a plurality of grooves which are formed on said circumferential surface of said through-hole of said boss of said oscillating arm at equal intervals in the circumferential direction of said through-hole, and said plurality of grooves extend over the entire of said through-hole of said boss in an axial direction of said through-hole of said boss;

said at least one through-hole of said support shaft comprises a plurality of through-holes formed in said support shaft at equal intervals in the circumferential direction thereof; and said at least one ball comprises a plurality of balls which are respectively arranged in said plurality of through-holes of said support shaft.

12. The apparatus as claimed in claim 10, wherein:

said plurality of ball receptacles of said oscillating arm comprise a plurality of grooves which are formed on said circumferential surface of said through-hole of said boss of said oscillating arm at equal intervals in the circumferential direction of said through-hole, and said plurality of grooves extend over the entire of said through-hole of said boss in an axial direction of said through-hole of said boss;

said at least one through-hole of said support shaft comprises a plurality of through-holes formed in said support shaft at equal intervals in the circumferential direction thereof; and said at least one ball comprises a plurality of balls which are respectively arranged in said plurality of through-holes of said support shaft.

13. The apparatus as claimed in claim 9, wherein:

said support shaft and said sanding member are separately formed from each other, and said sanding member is secured to a lower portion of said support shaft by means of a screw.

14. The apparatus as claimed in claim 10, wherein:

said support shaft and said sanding member are separately formed from each other, and said sanding member is secured to a lower portion of said support shaft by means of a screw.

* * * * *

UNITED STATES PATENT AND TRADEMARK OFFICE

CERTIFICATE OF CORRECTION

PATENT NO. : 5,482,499
DATED : January 9, 1996
INVENTOR(S) : Hiroshi Satoh

It is certified that error appears in the above-indentified patent and that said Letters Patent is hereby corrected as shown below:

Column 7, line 45, delete "end-of" and insert therefor --end of --.

Column 11, line 10, claim 9, after "communicate" insert --at --.

Signed and Sealed this

Twentieth Day of August, 1996

*Attest:*

*Attesting Officer*

BRUCE LEHMAN

*Commissioner of Patents and Trademarks*